United States Patent [19]

Phelps et al.

[11] 4,293,013

[45] Oct. 6, 1981

[54] LOG SPLITTER

[76] Inventors: Harold E. Phelps, 1916 Cornett Place; Byron J. Gansley, 1049 Spring Meadows, both of Kissimmee, Fla. 32741

[21] Appl. No.: 61,843

[22] Filed: Jul. 30, 1979

[51] Int. Cl.[3] ..... B27L 7/00

[52] U.S. Cl. ..... 144/193 A

[58] Field of Search ..... 144/193 R, 193 A, 287

[56] References Cited

U.S. PATENT DOCUMENTS

| | | | |
|---|---|---|---|
| 4,078,591 | 3/1978 | Syrjäläet al. | 144/193 R |
| 4,103,724 | 8/1978 | Braid | 144/193 A |
| 4,121,636 | 10/1978 | James | 144/193 R |
| 4,157,105 | 6/1979 | Gansley | 144/193 A |

FOREIGN PATENT DOCUMENTS

| | | | |
|---|---|---|---|
| 244777 | 6/1947 | Switzerland | 144/193 A |

*Primary Examiner*—Willie G. Abercrombie

*Attorney, Agent, or Firm*—Fisher, Gerhardt, Crampton & Groh

[57] ABSTRACT

A portable log splitter having a hydraulic cylinder for applying force to a log wherein the source of hydraulic fluid is a pump driven by a detachable power plant of the type used for chain saws. The cylinder is a two way cylinder which moves faster in the retracting direction than in the force applying direction to speed up the cycle of log splitting and the cutting blade is provided with guide members which permit a split to be completed with a short power applying stroke.

2 Claims, 7 Drawing Figures

5
5
10
12
14
18
20
22
24
26
27
28
30
32
34
36
38
40
42
44
46
48
50
52
54
56
64
65
66
72
86
91
93

14
26
27
28
30
32
36
38
40
44
48
12
66

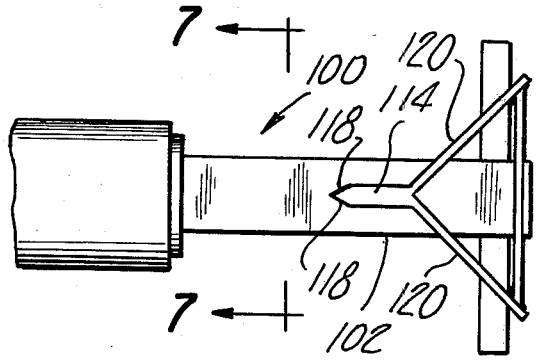
Fig-6
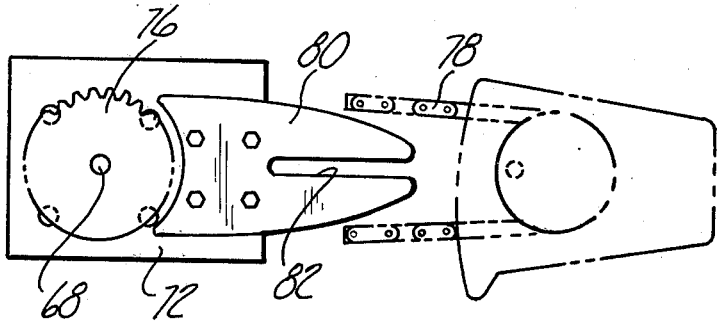
Fig-3
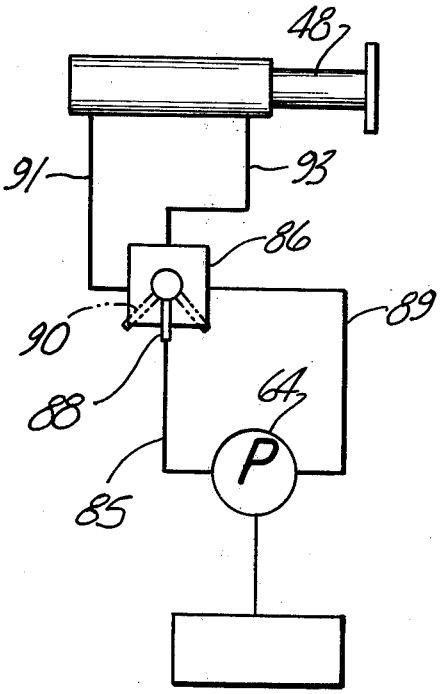
Fig-4
Fig-5
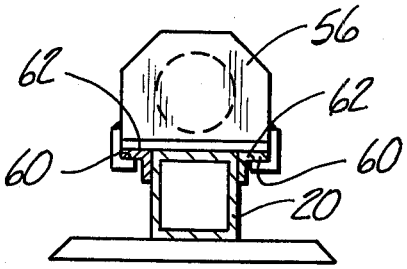
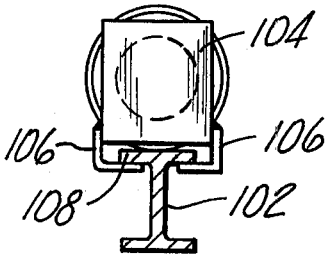
Fig-7

LOG SPLITTER

This invention relates to apparatives for splitting logs and particularly to a power driven, hydraulic log splitter.

Log splitters have been provided in which a force generated by a hydraulic cylinder has been used to split logs and when such log splitters are powered with engines or the like they become relatively heavy and as a consequence can be transported only with difficulty. As a result most such log splitters are supported on wheels so that they can be towed to and from a site at which logs are to split. This makes such splitters large and relatively expensive.

Log splitters often are used in conjunction with chain saws. The chain saws are used to fell trees and to cut the trunks of trees to appropriate lengths which subsequently are to be split. It would be highly desirable and as a consequence it is an object of this invention to provide a powered, hydraulic log splitter which uses the power source of the chain saw as the power source for the log splitter.

Another object of the invention is to provide a log splitter which is relatively light and which can be separated into two or more parts making the log splitter portable.

Another object of the invention is to provide a log splitter with a splitting arrangement so arranged that a minimum amount of hydraulic stroke is required to split.

The objects of the invention are accomplished by a log splitter in which a hydraulic actuator is supported on a base member to move a log against a splitting blade. The actuator is provided with hydraulic fluid under pressure from a hydraulic pump which is driven by a detachable power plant of the type used to power chain saws by substituting a driving chain from the power saw power plant to a hydraulic pump for the usual toothed cutting chain used on the chain saws. The power plant is rapidly detachable from the log splitter and the log splitter itself is separable into subassemblies which facilitate storage and transport.

These and other objects of the invention will be apparent from the description and from the drawings in which:

FIG. 3 is a partial end view indicating the driving arrangement;

FIG. 4 is a schematic view showing the hydraulic circuit;

FIG. 5 is a view taken on line 55 in FIG. 1;

FIG. 6 is a view of another embodiment of the invention; and

FIG. 7 is a cross section taken on line 7—7 in FIG. 6.

Figure 1:
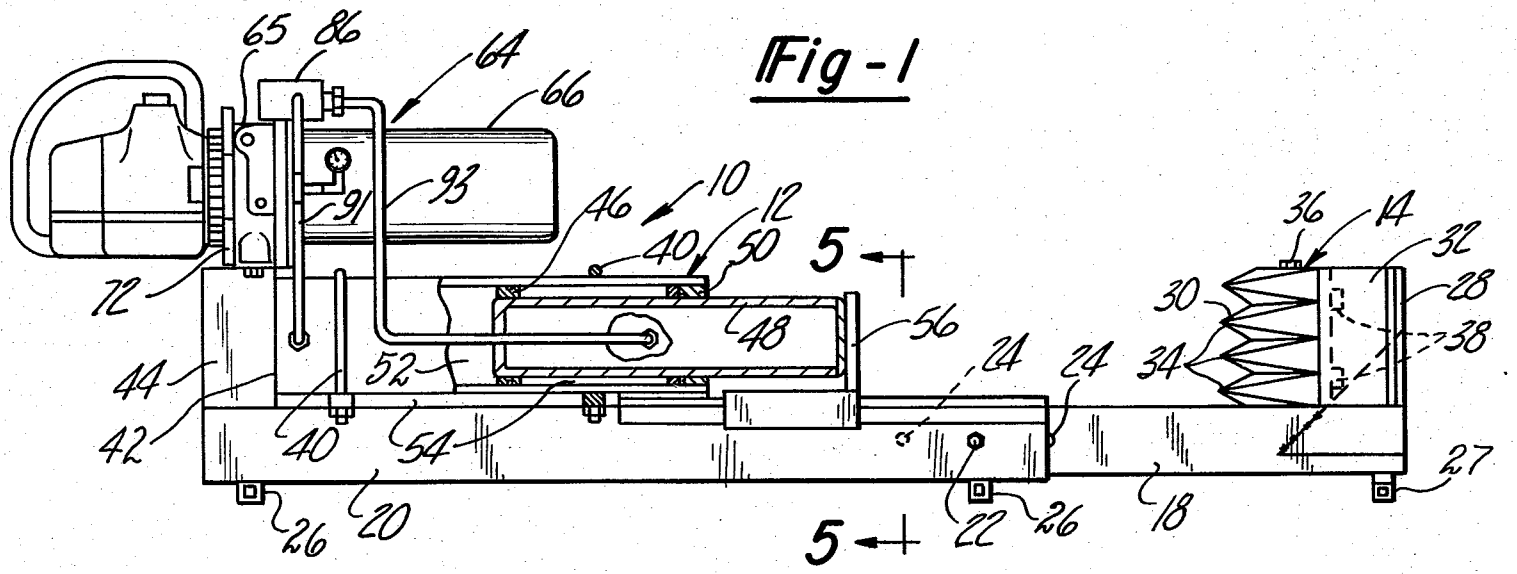
FIG. 1 is a plan view partly in section of a log splitter embodying the invention.
Figure 2:
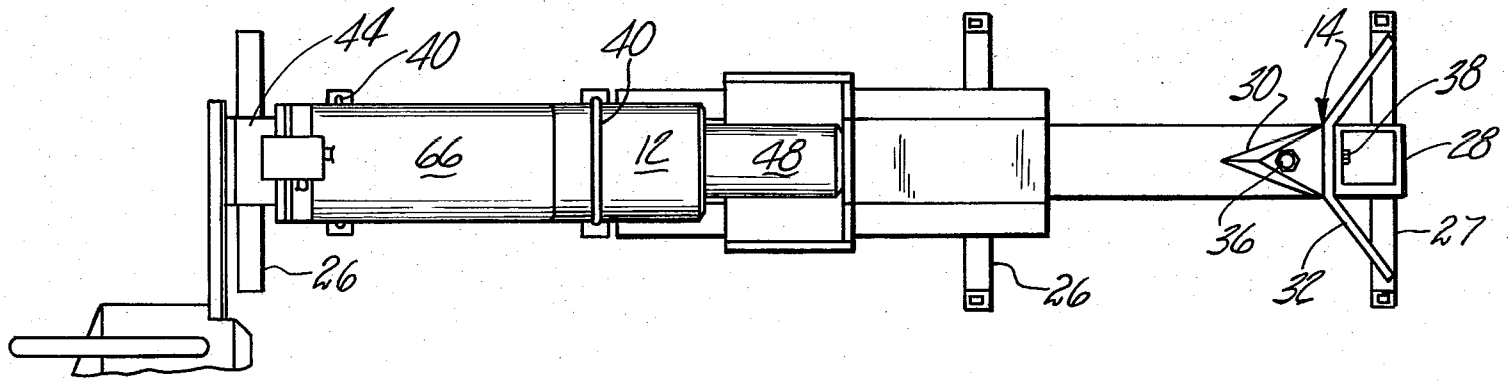
FIG. 2 is a top view of the log splitter seen in FIG. 1.

The hydraulic log splitter embodying the invention is designated generally at 10 and includes an hydraulic actuator 12 and a blade assembly 14 for engaging and penetrating a log which is pushed against the blade assembly 14 by the hydraulic actuator 12. The hydraulic actuator 12 and the blade 14 are mounted on a base assembly 16 which includes telescoping tubular members 18 and 20 having generally square, complementary cross sections. The smaller tube 18 telescopes within the larger tube 20. As seen in FIG. 1, the base assembly 16 is in a partially extended position and is held in that position by a pin 22 which passes through aligned openings in opposite walls of the tube 20 and through selected openings 24 in tube 18. This makes it possible to change and adjust the distance between the hydraulic actuator 12 and the blade assembly 14 for accomodating various sizes of logs during splitting operations or if desired, the pin 22 can be removed to collapse the base 16 or to separate the tubes 18 and 20 for storage or transport purposes.

The tube 20 is provided with transversely extending legs 26 and tube 18 is provided with a single transversely extending leg 27 which stabilizes the base assembly 16 on the ground.

The end of the smaller tube 18 has a vertical tubular bracket member 28 which locates and supports the blade assembly 14. The blade assembly 14 includes a toothed member 30 and a spreader member 32. The blade 30 has a plurality of teeth 34 and is held to the tube 18 by a means of a vertically extending bolt 36 anchored in the tube 18 and a pair of studs 38 which pass through a wall of a bracket 28, through the spreader 32 and into threaded openings formed in the toothed member 30.

The teeth 34 have triangular faces and form a saw-toothed arrangement that can be made of a single integral block of metal. If preferred, the teeth 34 can be made separate as disclosed more completely in patent 4,157,105 granted June 5, 1979.

The hydraulic actuator 12 serves to move logs against the blade assembly 14 during the splitting operation and is mounted on the larger tube 20 of the base 16. The hydraulic actuator 12 is held in position by a pair of U-bolts 40 which pass over cylinder 42 of the actuator so that one end of the cylinder 42 is held against a vertical bracket 44 fixed as by welding or the like to one end of the tube 20.

The hydraulic actuator 12 includes a piston 46 to which is attached a relatively large, hollow rod member 48 mounted to slide in an end wall 50 of the hydraulic actuator 12. The piston 46 and rod member 48 divide the cylinder 42 into a relatively large chamber 52 at one side of the piston 46 and a substantially smaller chamber 54 at the rod side of the piston 46. Delivery of hydraulic fluid under pressure to the large chamber 52 causes the rod member 48 to extend from the cylinder 42 and at the same time forces hydraulic fluid from the smaller chamber 54. Similarily, delivery of hydraulic fluid to the small chamber 54 retracts the rod member 48 and exhausts hydraulic fluid from the large chamber 52.

The end of the rod member 48 opposite to the piston 46 is provided with a pad 56 rigidly fastened to the end wall of the rod member 48. As seen in FIG. 5, the pad 56 is guided during movement of the rod member 48 by channel shaped guides 60 which receive flanges 62 formed on opposite sides of the base tube 20.

A pump assembly 64 for supplying hydraulic fluid to the actuator 12 can be any suitable hydraulic pump 65. In an actual embodiment of the invention a geared type pump manufactured by Webster Manufacturing Co. and identified by Model 172-86164 was used successfully. Pump 65 is mounted at one end of a tank 66 which forms a reservoir for the hydraulic system. The pump 65 is of the rotary gear type and is driven by a shaft 68 seen in FIG. 3. A plate 72 is fastened to the bracket 44 and also is fastened to the pump assembly 64 so that the shaft 68 projects from one side of the plate 72 and drivingly supports a sprocket 76. The teeth of the sprocket 76 are engaged by and driven by a chain 78. The chain 78 is guided by a drive bar 80 of the type commonly used with power driven chain saws although it may be substantially shorter than conventional chain saw drive bars. The drive bar 80 is bolted to the plate 72 and is provided with a slot 82 to receive the usual mounting bolt associated with chain saws for supporting the chain saw power plant 84 in the form of a gasoline motor relative to the drive bar 80. The chain 78 is substituted for the conventional toothed cutting chain of a chain saw and connects the power plant 84 in driving relationship with the pump 64.

When the chain saw motor 84 is operated, the sprocket 76 rotatably drives the pump 64 and delivers hydraulic fluid under pressure through line 85 to a control valve 86. The control valve 86 is a three position four way valve which operates in its neutral position indicated with the handle at 88 to recirculate hydraulic fluid through line 89 back to the tank 66 and the pump 64.

When the control valve handle is moved from its neutral position at 88 to the position indicated at 90 in FIG. 4, the hydraulic fluid under pressure is delivered through line 91, seen also in FIG. 1, to the large chamber 52 to cause extension of the piston rod 48. When the control valve handle is moved to the position indicated at 92 in FIG. 4, hydraulic fluid is delivered through line 93 to the small chamber 54 of the hydraulic actuator 12. Because of the large chamber 52, the piston 46 offers a large area so that for any given hydraulic pressure a substantial force is delivered to move the piston 46 and rod member 48 to the right as viewed in FIG. 1 so that the pad 56 moves a log disposed in its path against the blade assembly 14.

The blade assembly 14 is effective to initiate a split in a log and soon thereafter the wings 32 of the spreader, which diverge at a greater angle than the teeth 34, are effective to rapidly separate opposite sides of the log and complete the split in a relatively short distance. This makes it possible to have a hydraulic actuator with a relatively short stroke so that the overall length of the log splitter 10 is maintained at a minimum to facilitate transport and storage.

After the split of a log is completed, the handle of the control valve 86 is moved through the neutral position indicated at 88 to the position indicated at 92 in FIG. 4 to cause delivery of hydraulic fluid to the small chamber 54. The small chamber 54 has less than one half the volume of the chamber 52 and as a result, a given amount of hydraulic fluid delivered to the small chamber will cause the rod member 48 to be retracted at a much greater speed than the rod 48 is extended during the splitting operation. This makes it possible to complete a full cycle of the splitting operation in a short period of time.

During the splitting operation the chain saw power plant 84 is operated in the usual fashion, typically with a trigger type throttle control (not shown), and so long as the valve 86 is in one of its open positions and the engine is operating, hydraulic fluid is delivered to the actuator 12. To interrupt the splitting operation, the operator releases the throttle trigger and this interrupts the delivery of hydraulic fluid and stops the splitting operation and affords a safety advantage.

The log splitter 10 can be built in a variety of sizes and particularly in larger sizes, it is advantageous to be able to dismantle the assembly. For example, the tube 18 of the base member 16 may be separated from the tube 20 and the chain saw motor 84 may be removed from the drive bar 80 offering three separate components which may be loaded into a vehicle for transport much more easily than when the parts are completely assembled together. Also, since the log splitter 10 does not require wheels for transport as is common with the trailer type of log splitters, the transport vehicle becomes available to tow a cargo trailer for hauling the split wood.

Although the pump 64 together with the drive bar 80 and chain saw power plant 84 are illustrated as mounted above and on the remainder of the log splitter 10, it is contemplated that the pump assembly 64 with the chain saw motor 84 can be mounted on a separate base member and connected to the hydraulic cylinder by flexible conduits.

Referring now to FIGS. 6 and 7 another embodiment of the invention is shown in which a log splitter 100 has a base 102 made of a single unitary I-beam rather than of two parts as in the prior embodiment. In this instance the pad 104 at the end of the piston rod 48 is guided by angle members 106 which engage the upper flange 108 of the I-beam base member 102. Also, as seen in FIG. 6 a blade assembly 114 includes a cutting blade 116 having diverging splitting faces 118 and diverging spreader wings 120. As in the prior embodiment the wings 120 diverge at a greater angle than the cutting faces 118 of the blade to spread the log after the split in the log has been initiated so that opposed parts of the log are rapidly moved apart in a minimum distance of travel of the piston rod 48.

In all other respects the embodiment shown in FIGS. 6 and 7 is the same as the prior embodiment using the engine 84 of a chain saw and an identical chain drive for a hydraulic pump which delivers hydraulic fluid to the hydraulic actuator 12. As in the prior embodiment transport and storage of the log splitter is facilitated by the ability to remove the engine 84.

The log splitter has been provided in which both of the disclosed embodiments of the invention are highly portable and include a base member with a blade for penetrating one end of a log and a hydraulic actuator which forces the log against the splitting blade. The hydraulic fluid pressure for operating the actuator is supplied by a pump driven by a chain saw power plant wherein the cutting chain and guide bar of the chain saw are removed and the power plant is provided with a drive chain and a sprocket connected to a hydraulic pump. During operation one hand of the operator is used to control the chain saw power plant and the other hand is used to control a three position valve determining the extension and retraction of the rod of the hydraulic actuator forcing a log against the splitting blade.

The embodiments of the invention in which an exclusive property or privelege is claimed are defined as follows:

1. A portable log splitter comprising: a longitudinally extending base member, a blade assembly fixed on said base member for penetrating one end of a log, a hydraulic actuator mounted on said base member, a source of hydraulic fluid pressure including a rotatable hydraulic pump, power means for said pump including a sprocket drivingly connected to said pump, a guide bar in alignment with said sprocket and having a mounting slot, said slot receiving a chain saw engine on said guide bar for driving said pump and a chain extending over said guide bar and between said engine and said sprocket for driving said pump, valve control means disposed between said pump and said actuator and being manually operable to control the delivery of hydraulic fluid to extend said actuator into engagement with a log and force it into engagement with said blade assembly to split said log and being operable in an opposite direction to retract said actuator said engine being radially detachable from said guide bar for transport purposes and for use in a chain saw assembly.

2. The combination of claim 1 wherein said blade assembly includes a blade portion for piercing a log and initiating a split in said log and a pair of wing members diverging from opposite sides of said blade portion for completing said split, said wing members diverging from each other at a greater angle than the cutting edge of said blade portion.

* * * * *